United States Patent [19]

Williams

[11] 4,183,422

[45] Jan. 15, 1980

[54] UNDERWATER COMMUNICATIONS DEVICE

[76] Inventor: David W. Williams, 7716 Guildford, Hanover Park, Ill. 60103

[21] Appl. No.: 868,826

[22] Filed: Jan. 12, 1978

[51] Int. Cl.[2] ..... G10K 13/00; A62B 7/00; A63H 3/06

[52] U.S. Cl. ..... 181/173; 46/88; 46/182; 128/201.19; 179/1 UW; 181/18; 181/126; 181/174

[58] Field of Search ..... 181/173, 174, 18, 138, 181/167, 157, 158, 126; 128/141 A, 141 R, 145.8; 46/88, 175, 178, 182, 87, 90; 179/1 UW

[56] References Cited

U.S. PATENT DOCUMENTS

| | | | |
|---|---|---|---|
| 1,556,356 | 10/1925 | Russo | 46/88 |
| 1,595,441 | 8/1926 | Zenger | 46/178 |
| 1,730,532 | 10/1929 | Robbins | 181/157 |
| 2,099,871 | 11/1937 | Stern | 181/18 |
| 2,844,212 | 7/1958 | Hogan et al. | 181/18 |
| 3,210,723 | 10/1965 | Martelli et al. | 128/141 A |

FOREIGN PATENT DOCUMENTS

| | | | |
|---|---|---|---|
| 10746 | of 1889 | United Kingdom | 46/88 |
| 233193 | 5/1925 | United Kingdom | 46/88 |

*Primary Examiner*—Stephen J. Tomsky
*Attorney, Agent, or Firm*—John H. Shurtleff

[57] ABSTRACT

A communications device for use under water by a human speaker. A tubular base member has a mouthpiece located at one open end thereof and an inflatable air bag mounted about another open end thereof. In use, the speaker places the mouthpiece around his mouth to form an air seal therebetween and blows into the air bag to partially inflate it. When so inflated, the speaker talks into the device with voiced sounds being transmitted to the surrounding water through suitable transmitting means attached to the base member, preferably the air bag itself. During talking, the air bag receives and returns the air used by the speaker, thereby effectively preventing the escape of air bubbles from the device which otherwise interfere with communications. The air bag is preferably an elongated, flexible balloon which can be stretched into an extended position when speaking into it under water.

16 Claims, 13 Drawing Figures

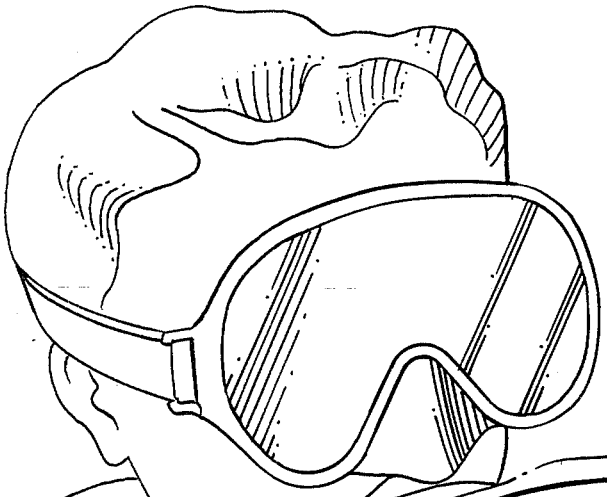
FIG. 1
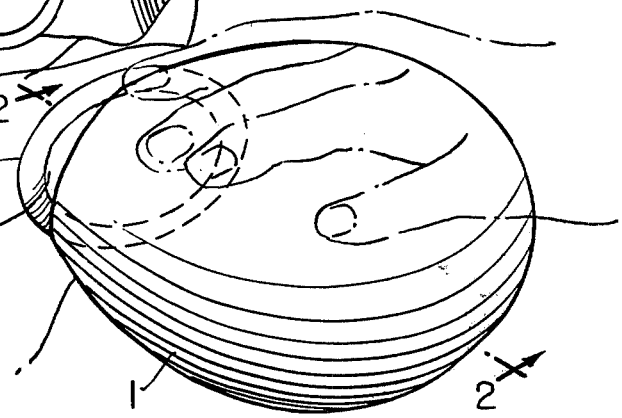
FIG. 5
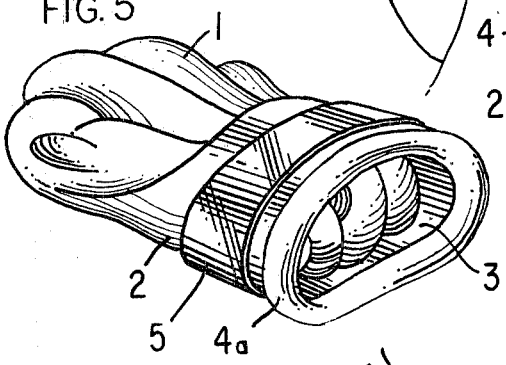
FIG. 2
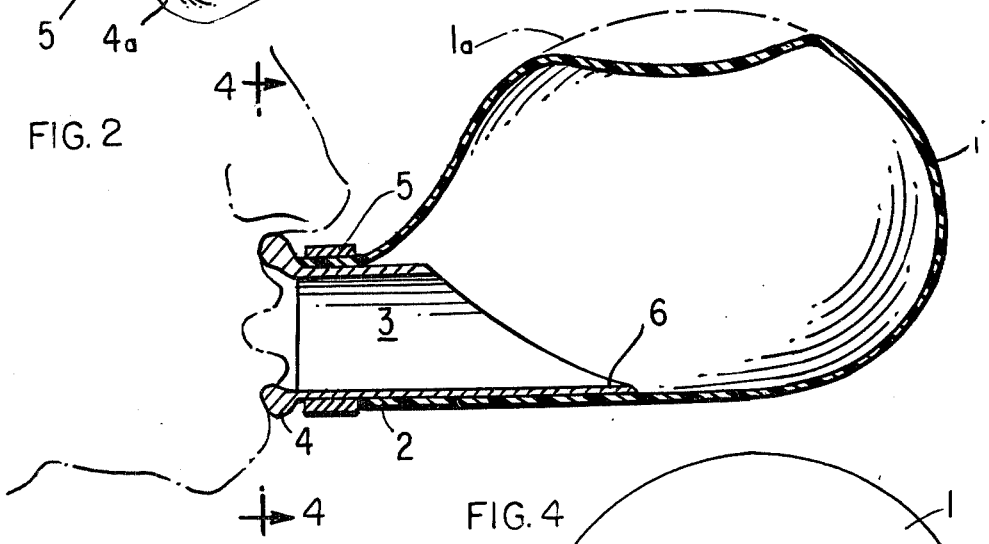
FIG. 4
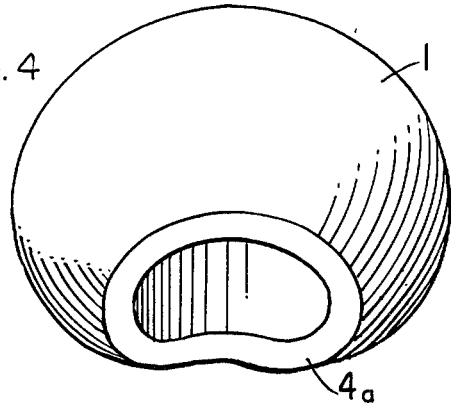
FIG. 3
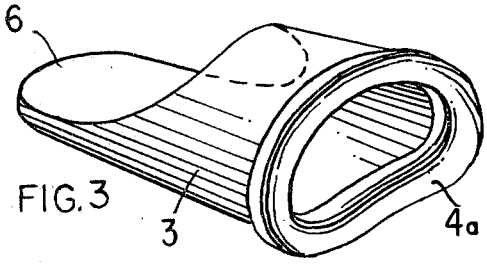

UNDERWATER COMMUNICATIONS DEVICE

INTRODUCTION

The present invention relates generally to an underwater communications device, and more particularly, to an inflatable and preferably stretchable device which allows a human speaker to talk under water and communicate with a human listener.

BACKGROUND OF THE INVENTION

Many variations of underwater communication devices are known as used from time to time by divers in both shallow and deep diving conditions. The only reliable devices previously developed have been those of electro-mechanical or electronic construction, especially wireless communication apparatus of a portable type which requires batteries, microphones, ear phones, transistors, and the like to be maintained in watertight housings and with essential watertight connections. Such devices are extremely expensive and the cost is doubled by the fact that each diver must be fully equipped to communicate with one another.

Attempts have been made to provide non-electronic devices for talking under water, but no such devices are currently available in the marketplace. One example of a purely mechanical device is the so-called "Scuba Com" described in an article entitled "Mighty Mouth" by Jack McKenney, see the July 1969 issue of Skin Diver Magozine) as utilizing a specially compounded silicone-rubber diaphragm designed to provide a mechanical, air to water impedance matching device. However, this device just as all other known purely mechanical devices has the disadvantage that air bubbles are exhausted therefrom during its use and these air bubbles create loud cracking or popping sounds drowning out or severely masking vocal communications emitted from the acoustic diaphragm.

In addition, such mechanical devices are limited by the need to be attached to a separate air supply in order to permit the speaker to fill his lungs after each use of one breath for speaking. When so attached to separate air supply, the device becomes bulky and cumbersome and must be worn at all times as a normal air supply. If not so attached, the speaker must regain a fresh supply of air from the usual air regulator after each short spoken message.

An earlier underwater speaking device with an acoustic diaphragm formed by a thin plastic or brass disc is disclosed in U.S. Pat. No. 2,844,212 with the diaphragm being disposed directly in the air regulator, i.e. the air breathing apparatus which also includes air intake and exhaust hoses and an air tank. Some of the difficulties in using this earlier device are discussed by Laughlin et al in their subsequent U.S. Pat. No. 3,174,129, wherein these and other problems were again avoided by returning to an electromechanical combination with a microphone equipped face mask directly connected to the air regulator or breathing apparatus.

BRIEF DESCRIPTION OF THE INVENTION

The present invention eliminates the above-noted problems and disadvantages found to exist in conventional or previously known mechanical or electromechanical underwater communication devices by providing a simple and inexpensive means for preventing the escape of air bubbles while one is using the device to talk or communicate vocally under water. The device also permits the air expelled by the speaker when talking to be inhaled again so as to permit speech or conversations spanning several breaths before it is necessary for the speaker to replenish his lungs with a fresh supply of oxygen.

In addition, the range of the device according to the present invention may be extended to 100 feet or more for the transmission of audible sounds under water by the simple expedient of stretching an elastic portion of the device during talking. These features of the invention overcome the need of utilizing very expensive electronic or electro-mechanical apparatus while still providing effective and reliable short range vocal communication between divers.

Other objects and advantages of the invention will become apparent in considering the following detailed disclosure.

DESCRIPTION OF THE DRAWINGS

FIG. 1 is a perspective view of an underwater communication device constructed in accordance with one embodiment of the present invention, illustrating its use by a diver;

FIG. 2 is a side, cross-sectional view taken along line 2—2 of the device shown in FIG. 1;

FIG. 3 is a side perspective view of a portion of the device shown in FIGS. 1 and 2;

FIG. 4 is an end view of the device shown in FIGS. 1 and 2;

FIG. 5 is a side perspective view of the device shown in the preceding figures to illustrate an air bag portion collapsed or folded into a tubular portion for storage purposes;

DESCRIPTION OF THE INDIVIDUAL EMBODIMENTS

Figures 6, 6A:
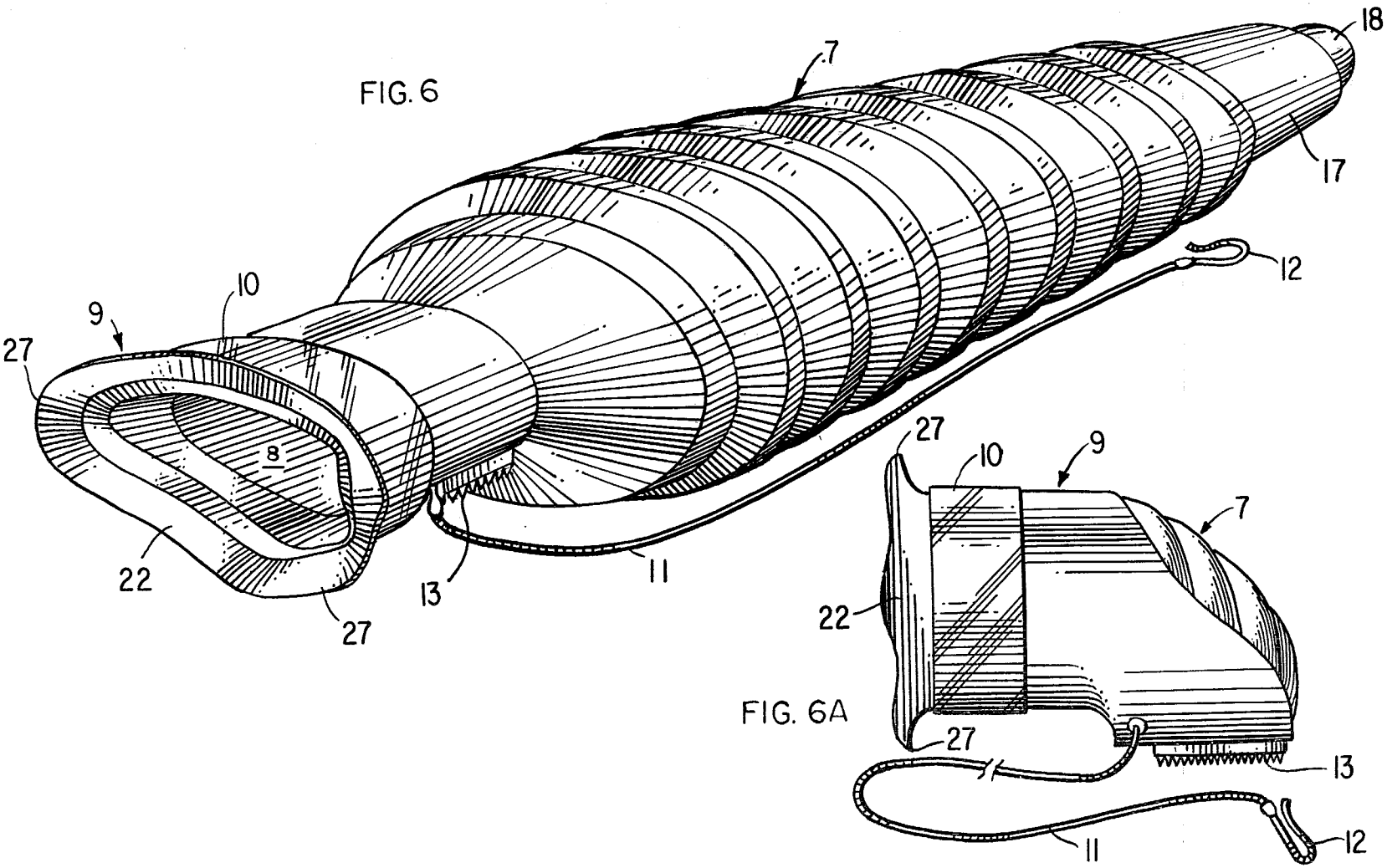
FIG. 6 is a perspective view of an underwater communication device constructed in accordance with a preferred embodiment of the present invention.
FIG. 6A is a side view of the preferred device shown in FIG. 6 to illustrate an air bag portion collapsed for storage.

The basic design of the underwater communications device according to the invention is best illustrated and explained in connection with FIGS. 1–5, representing one preferred embodiment which is easily constructed and is very compact and lightweight. In FIGS. 1 and 2, the device is shown as in actual use as the partially inflated air bag 1 is mounted by means of its neck portion 2 over the outer open end of a tubular base member 3 which has a mouthpiece 4 formed around its inner open-end. This mouthpiece 4 can be an enlarged integral portion of the base member 3 as shown, or else the mouthpiece 4 may also be a separate resilient member fastened onto or fitted over the inner open end of the tubular base member 3. This mouthpiece in any case acts to form an air seal around the mouth of the human speaker while talking under water.

The air bag 1 is preferably made as an elastic balloon which is composed of natural or synthetic rubber so that the neck portion 2 can be elastically fitted onto and securely held by the base member 3. However, for very inexpensive devices, it is feasible to use any thin, flexible, non-porous plastic film material as an air bag, e.g. a polyolefin such as polyethylene or polypropylene, a vinyl polymer such as polyvinyl chloride or even polyester or nylon films. One preferably selects those materials having the best sound transmitting properties such as the known silicone rubbers. Good results have also been achieved with natural rubber and neoprene. It is also possible to use rubber or plastic coated fabrics as still other examples of air bags. When using non-elastic materials, it is desirable to tightly fasten the neck portion 2 of the air bag 1 to the base member 3 by means of a strap or band 5 which may be an elastic band or other strap means to tightly hold the bag in place. When using elastic materials, which provide a self-fastening air bag, the band 5 may also be a chrome band or the like applied primarily as decoration, e.g. as indicated in FIG. 5.

In place of or in addition to this band 5, the mouthpiece and the adjacent base member can be provided with a hand or thumb grip (not shown) in order to permit the speaker to easily press the mouthpiece backwardly over his mouth. This fitting of the mouthpiece onto the mouth and holding it in position while talking is readily accomplished as shown in FIGS. 1 and 2 by gripping the base member 3 with the fingers and thumb pressing backwardly against the mouthpiece 4. In practice, it is generally sufficient to maintain a firmly pressed seal only above the upper lip of the speaker while permitting the bottom portion of the mouthpiece 4 to fit much more loosely around the speaker's lower lip. Sounds can then be better articulated without losing the desired air seal at the mouthpiece.

In its preferred economical form, a mouthpiece 4*a*, as shown in FIGS. 3–5 can be made of a rubber ring which can be taped or otherwise adhered to the inner rim of the base member 3. The size and form of the mouthpiece will vary, depending upon the intended use of the device. For example, for diving in pools and relatively shallow water depths, e.g. down to only 10 or 20 feet, an elastomeric mouthpiece 4*a* may be relatively small and with relatively large closed air cells trapped therein. For diving at substantially lower depths, it is desirable to use a more flattened out and denser rubber or elastomeric material in the mouthpiece since the water pressure will begin to compress any rubber or elastomeric material to a smaller size as the air cells are reduced in size at higher pressure.

The air bag 1 is shown fully inflated in the end view of FIG. 4 as well as the phantom line 1*a* in FIG. 2. During use, the air bag is only partially inflated and held in a slightly downwardly inclined position as it extends away from the mouth of the speaker, as shown in FIGS. 1 and 2, for example by preferably placing one hand over the top of the air bag 1 as the other hand presses the mouthpiece 4 over the speaker's mouth. The extended lip 6 helps to prevent the air bag 1 from rising during use, i.e. so as to maintain the bag is a relatively stable inflated position at about the same level as the mouthpiece or slightly lower.

As the speaker talks or voices sounds through the mouthpiece 4 into the air bag 1, air gradually exhaled to slowly inflate the bag 1 to its fullest size 1*a* as indicated in FIG. 2. The speaker then withdraws a small amount of air to partially deflate the air bag in order to again speak into the bag without depending upon a fresh supply of air from the usual air regulator or other air supply means.

It is not necessary to completely inflate the air bag during a spoken phrase or to completely deflate the air bag before the next spoken phrase. Instead, one should ordinarily inflate the air bag to at least about two-thirds of its full inflation capacity and then, while maintaining a substantial air seal between the mouthpiece and the speaker's mouth, words or sounds are spoken or vocalized through the mouthpiece into the bag until it is more fully inflated. The speaker then sucks or withdraws air from the bag to partially deflate it before repeating his speaking or vocalizing thereinto.

In order to enhance the length of time for speaking without removing the device and taking in a fresh supply of air from the regulator, it has been found to be especially desirable to maintain the air bag within certain size limits such that the air being used to speak into the bag and to again partially deflate the bag in one or more exchanges is approximately equal to or less than the so-called "respiratory dead space" of the speaker, i.e. the space in the mouth, throat and trachea where there is no exchange of carbon dioxide for oxygen. In general, it is therefore preferable to employ an air bag having a maximum air capacity of less than 1.5 liters and as a safety precaution approximately one liter or less. Preferred air bag sizes are thus about $\frac{1}{4}$ to 1 liter, preferably about $\frac{1}{2}$ to $\frac{2}{3}$ liter.

After repeating this speaking procedure a few times, usually not more than three or four times at most as an added safety precaution, the air in the bag can be purged with fresh air from the regulator or by the speaker removing the device from his mouth and breathing temporarily from the air regulator. The latter procedure is preferred while collapsing the air bag to completely deflate it and again partially inflating the bag from the mouth in the prescribed manner.

The collapsed and stored position of the air bag 1 in the base member 3 is illustrated in FIG. 5, substantially all of the bag aside from the neck portion 2 being folded and inserted into the outer open end of the tubular base member. The bag is thereby substantially completely collapsed and stored within a relatively small space so that the device can be kept in a readily accessible pocket or otherwise attached to the diver or his other equipment at any convenient place. The bag, because of its shape and flexibility, is easily pushed into the base member and then pressed out again when needed for speaking or vocalizing under water.

The primary advantage of this first air bag device as shown in FIGS. 1–5 is its function in maintaining a flow of air within the device when transmitting voiced sounds under water such that practically no air bubbles are expelled from the device or from the speaker to "drown out" or otherwise cause noise interference with the sounds being communicated. The solution of this particular problem offers for the first time an effective technique for speaking under water by mechanical means only. At the same time, this principle can also be adapted for use in an electro-mechanical device which contains an acoustical diaphragm such as a loudspeaker or smaller disc diaphragm as the primary means for transmitting voiced sounds as vibrations under water. The air bag may then act as a secondary means for transmitting voiced sounds or it may be limited to its main function of providing a flow of air entirely within the device during speaking or when making other voiced sounds under water. These and other variations based upon the separate functions of the air bag will be readily understood in view of the foregoing discussion, for example, so as to permit the air bag to be placed in gaseous communication with the mouthpiece by mounting it at any other open end of the tubular base member. Such other opening or open end may be directly adjacent to the mouthpiece as well as being at a maximum distance therefrom as generally illustrated herein.

In using the device of the invention, it is also important for the listener to remain quiet and to avoid the production of air bubbles in order to hear the sounds being transmitted. The speaker and the listener must cooperate to achieve good communications under water, but the techniques required are easily learned even by those who are not experienced divers.

The device of FIGS. 1–5 is best adapted for use in pools or shallow diving because its effective maximum range appears to be limited to about 6 to 8 meters, i.e. approximately 20 to 25 feet, and the best results are obtained at an even shorter range of up to about 4.5 meters or approximately 15 feet. However, there are many situations where even such close range communication between divers is essential, for example, in directing underwater filming where it is necessary to communicate with several divers at the same time.

Figure 7:
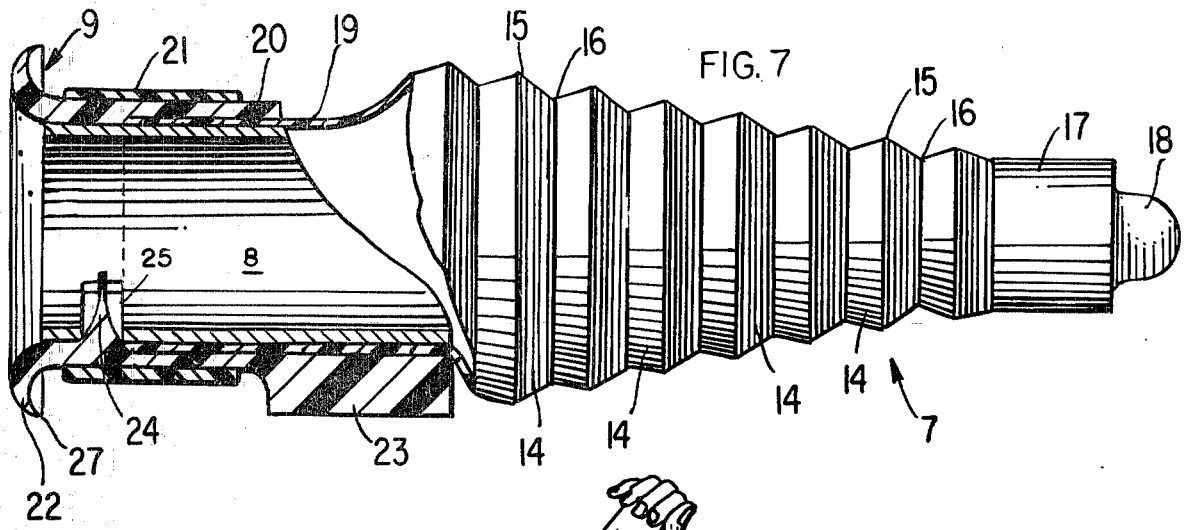
FIG. 7 is a side, partial cross-sectional view of the device shown in FIG. 6.
Figure 8:
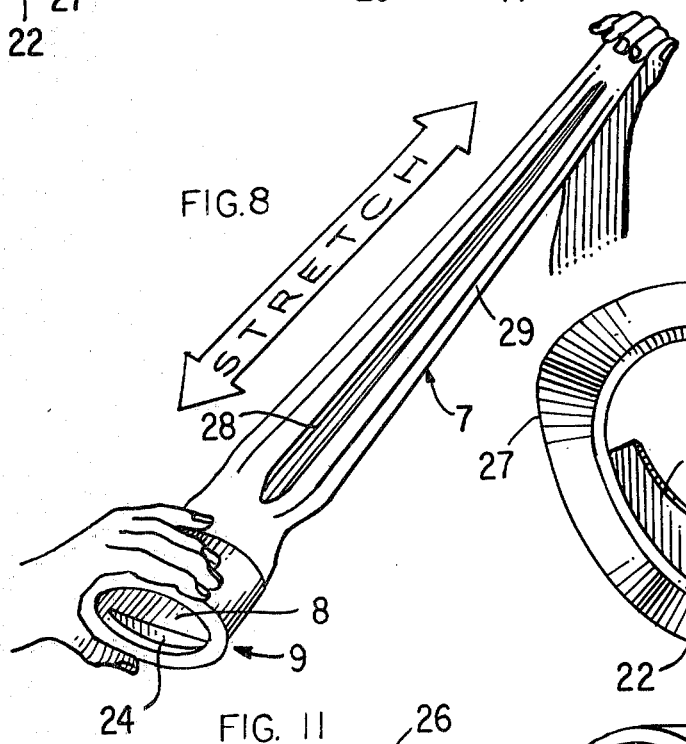
FIG. 8 is a perspective view in schematic form to indicate the manner in which the device of FIG. 6 is stretched during use.
Figure 9:
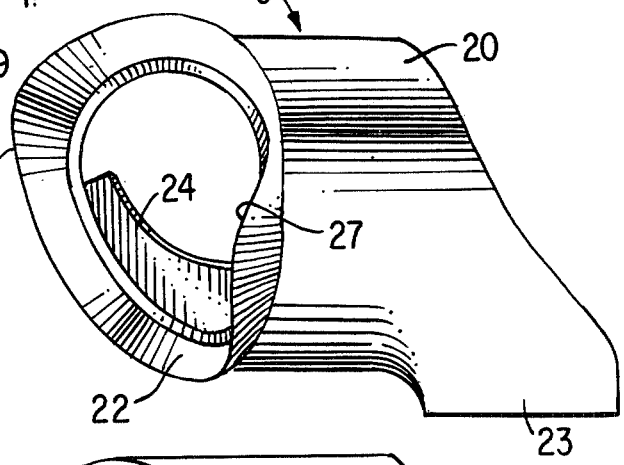
FIG. 9 is a partly perspective side view of the mouthpiece portion of the device shown in FIG. 6.

An especially preferred embodiment of the invention is illustrated by FIGS. 6–12 wherein the inflatable air bag essentially comprises an elongated, flexible elastic balloon or bladder capable of being longitudinally stretched by the speaker when transmitting voiced sounds under water, e.g. as indicated schematically in FIG. 8. Surprisingly, it is possible to increase the effective range of the device up to three or four times the distance achieved when using an unstretched bag or balloon. Ranges of up to about 23 meters or approximately 75 feet, or even more under favorable conditions, have been obtained with this particular embodiment of the invention, and such improvement in the range is attributed primarily to the stretched condition of the elastic air bag or balloon during its use both as a sound transmitting means and also as a means to retain air within the device to prevent the escape of air bubbles. Prior to the present invention, it was thought that such ranges would be impossible with a purely mechanical device, and the present elastically extensible or stretchable air bag therefore represents an unexpected advance in this art.

Referring now to FIGS. 6 and 6A, the stretchable air bag device for underwater talking according to the invention still retains the basic elements consisting of the air bag itself, generally denoted by the reference numeral 7, the tubular base member 8, and an overall mouthpiece unit or housing as generally denoted by the reference numeral 9. A fastening strap or decorative band 10 is preferred but optional so long as the air bag is securely joined to the tubular base member 8 and/or the mouthpiece unit 9. A lanyard 11 is preferably attached to the mouthpiece unit 9 with a clip 12 or other fastening means for connecting with the air regulator, e.g. to the air regulator hose near its outlet end, so that the diver can use both hands while retaining the air regulator in close proximity to his mouth. When a fresh air supply is needed after speaking through the stretchable underwater talking device of the invention, this lanyard connection assures an immediate location and use of the air regulator.

One Velcro pad 13 can be mounted on the bottom of the mouthpiece unit 9 so that the device can adhere to a complementary Velcro pad worn on the diver, e.g. on a vest, belt or the like. Such Velcro pads are well-known fibrous materials of hook and loop construction which adhere to each other when pressed together, the hooks of one pad engaging in the loops or eyes of the other pad. "Velcro" is a registered trademark, the product being readily available. Because the entire device of the invention is light in weight and also very compact when the bag 7 is collapsed or folded into the mouthpiece unit 9, i.e. within the inner tubular base member 8, as illustrated in FIG. 6A, it may be easily carried by the diver when not in use, and the lanyard attachment means 11 and 12 further ensures that the underwater talking device will not be lost or misplaced.

In FIGS. 6 and 7, the elongated, flexible, elastic balloon or bladder 7 is shown in its relaxed, non-stretched state, the partial cross-sectional view of FIG. 7 disclosing in greater detail the structure and assembly of the various parts. It will first be noted that the balloon 7 has a partly frusto-conical shape in the central part thereof as provided by a number of pleated annular segments 14 forming a series of ridges 15 and valleys 16 about its circumference transverse to its longitudinal axis. This "accordian pleating" is particularly helpful in holding the balloon or bladder 7 in an opened shape even when resting freely outside of the water. This kind of pleated structure also assists in opening out the balloon 7 under water as well as making it easier to fold or collapse for storage as in FIG. 6A. In partially inflating the air bag balloon under water, these pleats further offer a variation of internal volume without substantially changing its initial or "relaxed" elongated shape.

The outer end portion 17 of the balloon 7 may be cylindrical in shape, terminating with a nipple closure 18 or any suitable tab or flap which facilitates the hold or grip of one hand of the diver at this end for the purpose of stretching the balloon as in FIG. 8. The inner end or neck portion 19 of the balloon or bladder 7 is tightly secured between the tubular base member 8 and the mouthpiece unit 9 where the latter extends as a closely fitting tubular housing 20 concentrically around the balloon neck 19 and the base member 8. Because the balloon or bladder 7 is made of rubber or a similar elastomeric material, it can be stretch fitted at the neck 19 over the tubular base member 8 and safely held in place simply by the normal press fit pressure of the mouthpiece tube 20 applied thereto. However, in order to ensure the retention of the balloon 7 on the mouthpiece unit 7 during stretching, it is preferable to provide a circumferential band member such as the elastic band 21 which resiliently urges and secures the neck 19 onto the base member 8. This band 21 may also be added as a decorative feature, either by providing a bright distinctive color in the band itself or by adding an additional fabric or chrome band thereover. The same or additional bands may also be used to provide fastening means similar to the lanyard 11 or the Velcro pad 13. Such variations are to be included within the scope of the invention.

The mouthpiece unit 9 is made up of the contoured mouth ring 22 at its inner end, the tubular extended housing 20 and an enlarged bottom or mounting plate 23 for attachment of a Velcro pad or other fastening means such as a clip, snap fastener, loops for belting or the like. Such fastening means have been omitted from FIG. 7 since their use is optional. More importantly, the mouthpiece unit 9 can be effectively locked in place by an internal baffle member 24 in the form of a cross-bar which protrudes transversely into the interior of the mouthpiece unit through an arcuate slot 25 in the tubular base member 8.

Figure 11:
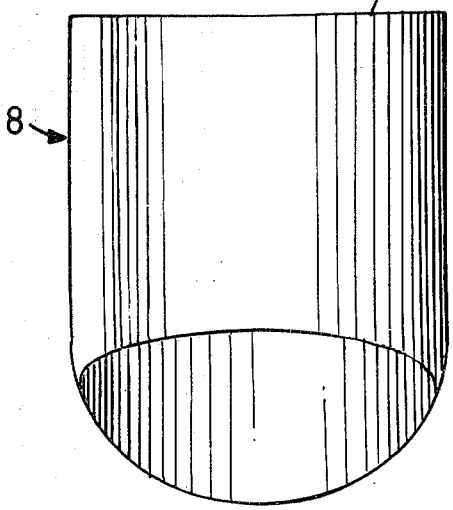
FIG. 11 is a top plan view of said tubular portion shown in FIG. 10.
Figure 10:
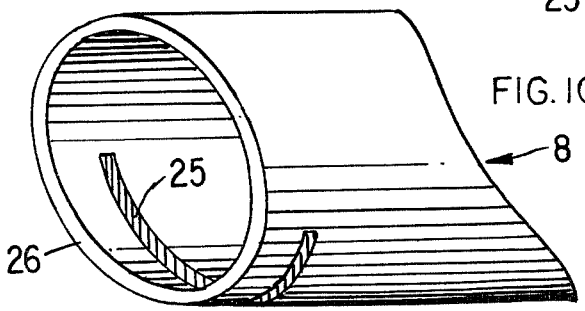
FIG. 10 is a partly perspective side view of the inner tubular portion of the device shown in FIG. 6.
Figure 12:
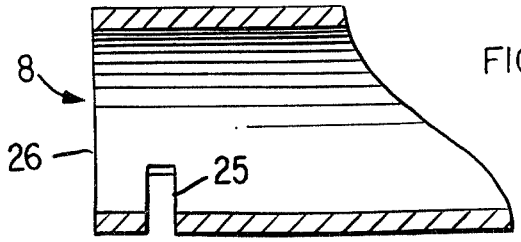
FIG. 12 is a longitudinal cross-sectional view taken along the center axis of the tubular portion shown in FIG. 10.

In the assembly of the device, reference may also be made to FIGS. 9–12 which offer a partly schematic illustration of the mouthpiece unit alone (FIG. 9) and three views of the tubular base member alone (FIGS. 10, 11 and 12). However, to achieve the interlocked assembly as shown by FIG. 7, the mouthpiece unit 9 can be drawn over the base member 8 from its inner end 26 and at least partly over the neck 19 of air bag 7 as already stretch fitted over the base member 8. After the baffle or cross-bar 24 reaches the base member end 26, it must be forced the last short distance into the slot 25, the baffle 24 being sufficiently thin and/or resilient to be easily deformed as it passes from the tube end 26, and along the side thereof until it is released into the slot 25. Once fitted in place, the mouthpiece unit provides a protective locking housing as well as the protruding mouth ring 22.

This mouth ring 22 is preferably flared outwardly as a tapered or gradually thinned out rubber flange which preferably curls backwardly and forwardly to form a loose-fitting mask at its outer edges 27 over a substantial facial area of the human speaker. In this manner, the mouth ring 22 can be carefully designed to conform to different facial contours while still forming an effective air seal. In this embodiment, it is also preferable to maintain a tight seal over the upper lip of the speaker while holding the mouth ring or mask 22 more loosely below the lower lip and around the lower sides of the face. For longer distance communications with this device, it is important to speak as loudly and distinctly as possible.

The baffle member 24 has at least one additional function besides that of interlocking with the tubular base member 8 through slot 25. This baffle or cross-bar 24 tends to prevent water from draining into the air bag or balloon 7 when it is held in a slightly inclined position downwardly away from the mouth of the speaker. Also, because it may be not be possible to completely keep water out of the bag 7, the baffle 24 also helps to prevent water in the bag from flowing back into the mouth if the bag together with the mouthpiece unit 9 is inclined upwardly away from the mouth of the speaker. The baffle 24 thus forms a dam across the lower portion of the base member adjacent to the mouthpiece, i.e. adjacent the inner mouthpiece end of the device. It is further believed that this baffle member 24, if made as a thin, resilient, resonating structure, can act as a vibrating reed means or a "tuning bar" which may reinforce or enhance at least certain frequences of vibrations within the air bag as a resonant chamber. The stretching of the elastic air bag or balloon 7 appears to result in changes in the natural resonance of the cavity or sound chamber formed by the balloon at different lengths. It is possible that such resonance accounts for the greater audible range achieved with this preferred embodiment.

Referring again to FIG. 8, it will be noted that the air bag 7 as a stretched balloon or bladder offers a very different appearance from that shown in its rest state or relaxed position of FIGS. 6 and 7. Thus, as the bag 7 is stretched longitudinally, a series of grooves or folds 28 or 29 extend over most of the length of the bag, at least in the frusto-conical portion thereof. These grooves or folds appear most visibly or with the greatest indentation and overlapping when the bag is only slightly inflated. Then, as the bag is held in the stretched position and slowly filled with more air when speaking thereinto, the bag expands slowly in a radially outward direction with the grooves and folds gradually filling out and disappearing as the bag becomes completely filled with air. It will be observed that the bag has the same stretched length throughout the speaking procedure even though it expands and contracts radially.

The speaking procedure or method is essentially the same as that described with reference to the embodiment of FIGS. 1–5, except that the grooves or folds 28 or 29 as shown in FIG. 8 may be observed by the speaker to judge the point at which speaking should stop and also the point at which sufficient air has been withdrawn or removed in order to start speaking again. The size or air volume of the bag is also the same, i.e. preferably up to about 1 liter, and especially about $\frac{1}{2}$ to $\frac{2}{3}$ liter.

Depending upon the rubber or other elastomeric material used in the embodiment of FIGS. 6–12, as well as its thickness and strength, the air bag 7 as a balloon or bladder should ordinarily be stretched at least about 1.2 times up to about 3 times its original non-stretched length. In practice, it is usually sufficient to provide a stretch of about 1.5 to 2 times the original non-stretched length of the bag. Natural rubber and similar highly elastic and resilient materials are most easily stretched to a maximum length whereas a synthetic rubber such as neoprene is much more difficult to stretch, given the same size and thickness of the bag. Exact specifications can be readily determined for any given material, both natural rubber and neoprene rubber having been successfully used as air bags.

Elastomeric air bags are most easily produced by dip molding from a suitable rubber or latex formulation. Dip molding also permits the bag to be formed with different thickness over its length, for example in forming a thicker or reinforced nose or end portion 17 to provide a firmer hand grip for stretching and also to avoid potential damage from finger pressure. Since the frusto-conical or other center portion of the bag 7 is used to transmit vibrations, remaining relatively loose and free to vibrate during the speaking cycle, the rubber or other elastomer may be considerably thinner in each pleat or fold 14. One can also construct this central portion of uniform thickness or as annular bands of different thickness or alternating thickness from band to band. In this respect, the present invention is not limited to the preferred pleated structure of the air bag but also contemplates equivalent vibrations which will yield similar results. The neck portion 19 of the air bag 7 may also have a greater or reinforced thickness to ensure a tight and secure fit within the base member 8 and the mouthpiece unit 9. Also, with a substantially greater thickness of material at either end of the air bag, i.e. in the nose 17 and the neck 19, the thinner central or intermediate portion when stretched forms a more natural diaphragm-like unit free to vibrate between the thicker and heavier nose and neck portions. In this sense, the air bag provides not only a resonance chamber of variable size but also a very large area of vibrating walls or panels formed by the central frusto-conical portion.

This second especially preferred embodiment, e.g. as generally shown in FIGS. 6 and 6A is useful down to maximum skin diving depths, e.g. as far as 200 feet below the surface. Tests have shown that the range of audibility improves with increasing depth, and excellent results have been achieved at more usual depths of about 20 to 60 feet. The ability to carry out brief conversations at these depths is especially important to avoid the problems of communicating solely by hand signals or by resurfacing to pass along important information or instructions. Because any diver within range can listen to a particular speaker, groups of workers or performers in underwater construction work or film projects can be instructed at the same time in relatively complex situations. For pleasure diving, any two skin divers can well afford the relatively inexpensive communication devices of the present invention in order to spend maximum time under water. The method of using these improved devices is dictated to a large extent by the essential structure and function of the individual elements. However, the method has it own unique features which may be readily mastered by inexperienced as well as experienced skin divers.

I claim:

1. A communications device for use under water by a human speaker, said device comprising:

a tubular base member;

a mouthpiece located at one open end of said tubular base member and sufficiently large to extend around and over the mouth of the speaker to substantially form an air seal thereabout such that air used by the speaker while voicing sounds passes through said mouthpiece into said tubular base member; and means attached to said tubular base member for transmitting voiced sounds, free of air bubbles, as vibrations to the surrounding water, said means including an inflatable air bag mounted about another open end of said tubular base member in a manner so as to receive said air used by the speaker while voicing sounds into said mouthpiece, thereby preventing the escape of air bubbles from the device when transmitting said voiced sounds under water.

2. The communications device of claim 1 wherein said transmitting means comprises said inflatable air bag constructed as a flexible, diaphragm-like unit which will vibrate in the water when partially inflated.

3. The communications device of claim 2 wherein said inflatable air bag is collapsible within said base member for storage purposes.

4. The communications device of claim 3 wherein said inflatable air bag comprises an elongatable, flexible, elastic balloon.

5. The communications device of claim 2 wherein said inflatable air bag comprises an elongated, flexible, elastic balloon capable of being longitudinally stretched by the speaker when transmitting voiced sounds under water.

6. The communications device of claim 5 wherein said elongated balloon has pleated annular segments forming a series of ridges and valleys about its circumference transverse to its elongated axis.

7. The communications device of claim 5 wherein said air bag is collapsible within said base member for storage purposes.

8. The communications device of claim 5 wherein said elastic balloon is stretchable to a length of about 1.2 to 3 times it original non-stretched length.

9. The communications device of claim 2 wherein said inflatable air bag has a tubular neck portion secured to said base member adjacent to said mouthpiece.

10. The communications device of claim 9 wherein a circumferential band member resiliently urges and secures the neck portion of said inflatable air bag onto said base member.

11. The communications device of claim 2 wherein an internal baffle member forms a dam across a lower portion of said base member adjacent to said mouthpiece.

12. The communications device of claim 5 wherein said elongated balloon is constructed with a series of ridges and valleys over the length of the balloon to form longitudinal grooves and folds which gradually fill out and disappear as the balloon is longitudinally stretched and inflated.

13. A method of communicating by a human speaker under water through the use of a sound transmitting device having a tubular base member with a mouthpiece located about one end to fit around and over the mouth of the speaker and means to transmit voiced sounds free of air bubbles including an inflatable transmit voiced sounds free of air bubbles including an inflatable air bag mounted about another end of said tubular base member, said method comprising:

substantially forming an air seal between said mouthpiece and the mouth of the speaker;

partially inflating said air bag by blowing air through said mouthpiece;

speaking into said air bag through said mouthpiece until said bag is more fully inflated; and at least partially deflating said air bag before repeating said speaking thereinto.

14. The underwater communications method of claim 13 further comprising stretching said inflatable air bag in the form of an elastic sound transmitting means in a longitudinal direction away from the mouthpiece when speaking thereinto.

15. The underwater communications method of claim 14 wherein said air bag is stretched from about 1.2 to 3 times its original non-stretched length when speaking thereinto.

16. The underwater communications method of claim 14 wherein said air bag is stretched about 1.3 to 2 times its original non-stretched length when speaking thereinto.

* * * * *

UNITED STATES PATENT AND TRADEMARK OFFICE

CERTIFICATE OF CORRECTION

PATENT NO. : 4,183,422

DATED : January 15, 1980

INVENTOR(S) : David W. Williams

It is certified that error appears in the above-identified patent and that said Letters Patent are hereby corrected as shown below:

In column 1, line 30, change "Magozine" to --Magazine--;
In column 1, line 42, after "attached to" insert --a--;
In column 3, line 58, change "pressure." to --pressures.--;
In column 3, line 68, change "the bag is a" to --the bag in a--;
In column 6, line 28, change "part" to --portion--; and
In column 10, lines 35-36, cancel "transmit voiced sounds free of air bubbles including an inflatable".

Signed and Sealed this

*Seventeenth* Day of *June 1980*

[SEAL]

*Attest:*

SIDNEY A. DIAMOND

*Attesting Officer*

*Commissioner of Patents and Trademarks*